United States Patent [19]

Cederquist

[11] Patent Number: 4,604,957

[45] Date of Patent: Aug. 12, 1986

[54] METHOD FOR WET COMBUSTION OF ORGANIC MATERIAL

[75] Inventor: Karl N. Cederquist, Stockholm, Sweden

[73] Assignee: Sunds Defibrator AB, Stockholm, Sweden

[21] Appl. No.: 703,257

[22] Filed: Feb. 20, 1985

Related U.S. Application Data

[63] Continuation of Ser. No. 551,977, Nov. 5, 1983, abandoned.

[51] Int. Cl.[4] ..... F23G 7/04

[52] U.S. Cl. ..... 110/238; 110/212; 110/204; 110/346

[58] Field of Search ..... 110/203–205, 110/210–214, 238, 346; 122/7 C

[56] References Cited

U.S. PATENT DOCUMENTS

| | | | |
|---|---|---|---|
| 2,808,011 | 10/1957 | Miller et al. | 110/238 |
| 3,207,572 | 9/1965 | Saul | 423/204 |
| 3,530,806 | 9/1970 | Bowman | 110/212 |
| 3,749,031 | 7/1973 | Burden, Jr. | 110/212 |
| 3,807,321 | 4/1974 | Stockman | 110/212 |
| 3,954,381 | 5/1976 | Marecaux | 110/238 |
| 3,985,510 | 10/1976 | Taylor | 110/238 |
| 4,085,688 | 4/1978 | Smith et al. | 110/238 |
| 4,317,417 | 3/1982 | Foresto | 110/213 |
| 4,437,417 | 3/1984 | Roberts | 110/238 |

FOREIGN PATENT DOCUMENTS 2143077 3/1972 Fed. Rep. of Germany .

*Primary Examiner*—Henry C. Yuen
*Attorney, Agent, or Firm*—Eric Y. Munson

[57] ABSTRACT

The wet method of combusting organic material dispersed in a liquid comprising waste liquor from wood pulping processes in which the organic material is oxidized by contact with air or other oxygenating gases at a temperature ranging between 180° C. and 340° C. and a correspondingly superatmospheric pressure. The combustion of oxygenation is carried out in two steps: namely, a first step in which the organic material is partially oxidized so that the major portion of the organic substances is converted into carbon dioxide and water, and a minor portion is converted to water-soluble low-molecular fatty acids resistant to oxidation; in a second oxidizing step, the residual oxygen-resistant fatty acids are combusted in the presence of a substantial excess of oxygen-enriched air or other molecular-oxygenating gas so as to liberate the total heat of combustion of the organic material and to impart to the resultant gaseous mixture of effluents a molecular oxygen content sufficient to achieve the partial oxidation in the first step.

2 Claims, 1 Drawing Figure

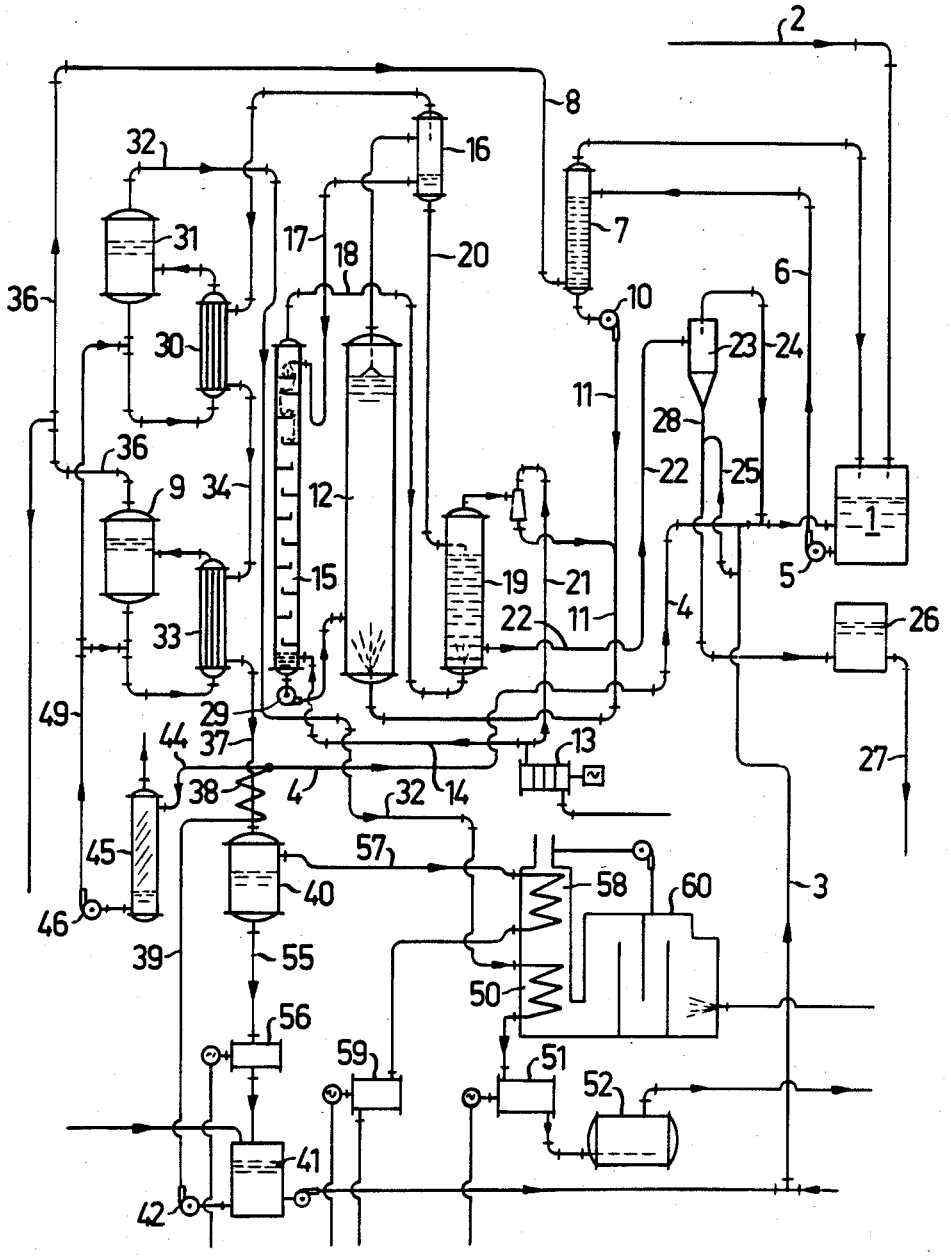
2
8
16
32
31
17
18
20
7
6
36
10
30
23
24
11
28
36
9
34
12
22
25
1
15
19
21
5
22
11
4
26
33
29
49
44
37
13
27
38
4
32
14
45
57
40
58
60
3
46
39
55
50
56
59
51
52
41
42

METHOD FOR WET COMBUSTION OF ORGANIC MATERIAL

This is a continuation of application Ser. No. 06/551,977 filed 11/5/83, now abandoned.

BACKGROUND OF THE INVENTION

It is known since long ago to combust totally or partially organic material dissolved or finely suspended in water by means of molecular oxygen or gases containing molecular oxygen, such as air. for example, under pressure and at elevated temperature, which depending on the degree of combustion and the nature of the organic substance should be in the range of 180° to 340° C. The process is suitably carried out continuously, and the combustion can be performed both in concurrent flow or in counter-current flow with an almost complete conversion of the molecular oxygen. When using air in the combustion of e.g. lignocellulose-containing biologic substance, such as wood, peat, bagasse etc., or waste liquors obtained by acid or alkaline pulp digesting of biologic substance, the escaping combustion gases seldom contain more than 0.2% of molecular oxygen. Nevertheless, if a nearly complete combustion of the organic material is to be obtained, the combustion temperature usually must exceed 300° C., e.g. be maintained between 300° and 340° C.

Due to the continuously declining content of oxygen during the course of the combustion process, the complete oxidation of the organic material into carbon dioxide and water is concommitantly impaired. During the combustion process, especially in the combustion of lignocellulosic material, compounds are formed which are resistant to oxidation and consist mainly of acids of low molecular weight, such as acetic acid, proprionic acid, or salts, and this formation occurs whether the combustion takes place in concurrent or in counter-current flow.

In the wet combustion process the starting liquid may lose volatile combustible material by being expelled together with the effluent mixture of steam and gas formed by the combustion, irrespective whether the combustion takes place in counter-current or concurrent flow. Volatile products can be present firstly in the starting liquid and secondly be formed during the combustion. Due to the low concentration of molecular oxygen in leaving flue gas in the final stage of the combustion, there exists the risk that the volatile products remain unaffected, and either remain in the solution as e.g. salts, or accompany the generated steam. However, experiments have shown that excess molecular oxygen and of high concentration as in air, for example, or higher, such as from 20° to 50%, facilitates the combustion of the compounds resistant to oxidation, which when they result from combustion of biologic substance or products thereof, normally consist of fatty acids having low molecular weight, primarily acetic acid.

In the event the starting liquid is alkaline and the formed acids are bound as salts, generally the same problem exists, namely, to break down the acids into carbon dioxide and water, as when the acids are free.

A great advantage with the combustion in alkaline solution is, however, that the generated steam is free from acidity, which facilitates use thereof for heating and power generating purposes and simplifies selection of suitable construction material for these purposes.

It is further known from experience that the combustion of lignocellulosic biologic substances or products thereof can be performed under relatively moderate temperature conditions, such as between 180° and 300° C., if the released amount of heat is restricted to between 75% and 90% of the total calorific value of the organic material, but that higher temperatures are required to release the remaining 5% to 10% of the calorific value, and in that case where this organic material consists of acids of low molecular weight, the combustion temperature must substantially exceed 300° C.

From experiments made with wet combustion of alkaline waste liquor from digestion of wood by means of pure sodium hydroxide solution and from the results referred to below, it becomes evident that use of a surplus and high concentration of oxygen gas in the final stage of the combustion process facilitates the breakdown of the compounds resistant to oxidation into carbon dioxide and water.

By way of example, a waste liquor obtained by digestion of pine-wood by means of 220 g NaOH and 2 g of anthraquinone per kilogram wood calculated as bone dry substance was combusted at a temperature of 170° C. into a pulp yield of 47.8%. The waste liquor had a dry solids content of 14.7% with a calorific value of 3,762 Cal per kg and contained 24.6% of $Na_2O$ calculated as bone dry substance. In the combustion of this waste liquor in an autoclave while using air with an initial pressure of 3,800 kPa at 20° C., with a consequent partial pressure of the oxygen gas amounting to 800 kPa at 20° C., 83% of the calorific value of the waste liquor was set free at a temperature of 275° C., and the partial pressure of the oxygen gas dropped to 400 kPa. Thereupon, the temperature was raised to 300° C., whereby additional heat was released so that the total amount of released heat amounted to 90% of the calorific value of the original waste liquor. The partial pressure of the oxygen gas had dropped to 250 kPa.

In a similar experiment, the combustion was started with air having the same partial pressure of the oxygen gas of 800 kPa as in the preceding experiment. Hereby 89% of the calorific value of the waste liquor was released when a temperature of 275° C. had been reached. Now pure oxygen gas was supplied and the temperature was raised to 300° C., when altogether 96% of the calorific value of the waste liquor was released. The partial pressure of the oxygen gas was then 500 kPa calculated at 20° C. and represents a surplus of oxygen gas twice as great as that in the final stage of the previous experiment, in which the complete combustion process to a final temperature of 300° C. was carried out with the quantity of molecular oxygen which was present in the air supplied at the start.

SUMMARY OF THE INVENTION

To reach a high degree of combustion in the combustion of lignocellulosic biologic substance without resorting to extraordinary conditions of temperature substantially exceeding 300° C., such as e.g. to 340° C., the combustion in the final stage must be effected with a great surplus of molecular oxygen, and in order to simultaneously limit the consumption of oxygen for all the organic material present in the waste liquor, the combustion must be carried out in two separate steps. In the first step the combustion of the incoming liquid containing organic substance is carried to such degree of combustion that between 75% and 95% of the calorific value is released, which can be done with small surplus of molecular oxygen, and, in the second step, the remaining organic substance is combusted with a great surplus of molecular oxygen in such a manner that steam and gas effluent from this second step can be fed to the first step with a content of oxygen gas adjusted so that the combustion in this step can be effected to the aforesaid degree of 75%–95%. If desired, an additional amount of molecular oxygen may be supplied to the effluent steam and gas so as to achieve the stated degree of combustion. The gas containing the molecular oxygen going into the second step must be saturated with steam of 300° C. in order to avoid cooling of the liquid in the second step and thereby creating too low a combustion temperature.

Assuming that 10%, for example, of the previously-mentioned combustion heat of the earlier mentioned waste liquor remains after the first step and that air is used for the combustion, the surplus of molecular oxygen in the second step becomes about 10 times greater than the theoretical requirement, if the whole quantity of air necessary for the combustion of the organic substance is supplied to the second step.

Instead of air, one can advantageously use air enriched with oxygen gas, e.g. with between 20% and 50% of $O_2$, or other inert gases having a higher content of molecular oxygen than air. Considering solely the reaction mechanism, it is advantageous to use pure oxygen gas, as has been verified also, but for reasons of safety, it appears not to be adviseable to operate with higher oxygen contents than 30%–50% of the gas entering into the combustion zone.

The compressed air enriched with oxygen can be prepared depending on the local conditions either by mixing together air and oxygen gas at atmospheric pressure and thereupon compressing the gas mixture, or by mixing compressed air with oxygen air under pressure, e.g., by vaporization of liquid molecular oxygen.

The combustion gases leaving the wet combustion plant can also be recirculated under substantially the same pressure that prevails in the combustion apparatus, after having been liberated, for instance under pressure, from formed carbon dioxide and possibility of excess of inert gases, e.g. nitrogen, and thereafter having been supplied with an adequate quantity of oxygen gas under pressure.

Usually, the wet combustion process is carried out in concurrent flow, but in the process suggested herein, it may in many cases be more suitable to carry out the combustion in the second step in a counter-current flow, which takes into account the fact that the liquid fed into the second step consists of a relatively small quantity due to the evaporation of the starting aqueous solution which resulted from the escape of vapour during the combustion process.

For example, when waste liquor containing 18% of dry substance, where of 81% is organic material, from a pure soda cook, is combusted, the waste liquor must be diluted with water in order for the generated heat to be converted entirely into vapour. Furthermore, water must be added for removing the soda formed during the combustion process. In this case, only 10%–12% of the amount of water going into the first step will be supplied to the second step, where it is finally oxidized. This is done most effectively in a counter-current flow in e.g. a tower filled with annular elements which increase the surface of contact between the liquid and the molecular oxygen containing gas, which facilitates the diffusion of the gas into the liquid and thereby accelerates the combustion reaction. The filling material of the tower may be made of materials which in a catalytic manner stimulate oxidation, such as, for example, nickel or chromium, vanadium, titanium, etc., containing alloyed steel, or the tower filling material may be coated with active material, e.g. platinum or nickel etc., precipitated on ceramic materials. It is also possible to utilize heterogeneous catalysts in the form of powder, e.g. copper chromite, finely divided platimum which is added to the starting liquid and after finished oxidation and removal is separated or precipitated, and, if desired, reactivated and recirculated. The types of catalysts to be selected depend mainly on the environment in which the combustion of the organic material is to be performed, i.e., acid, neutral or alkaline.

BRIEF DESCRIPTION OF THE DRAWING

The drawing is a diagrammatic view of a plant which operates according to the invention.

DETAILED DESCRIPTION OF THE INVENTION

In order to exemplify how the process may be carried out, reference is made to the following example and the accompanying drawing. The drawing figure is a flow sheet indicating the essential equipment parts of a plant for carrying out combustion of black liquor from the production of kraft pulp using a sulphur-free sodium hydroxide solution for the recovery of soda. Since the waste liquor is alkaline, no problems arise regarding purification of the water vapour leaving the process. On the other hand, i.e., when non-combusted volatile compounds are formed and follow along with the water vapour, e.g. free acetic acid, problems may arise, as acid must be removed in one way or the other, either directly from the water vapour or from the vapour condensate.

Referring now to the example shown in the drawing, black liquor from a pulp production process of a capacity of 20 t/h comprising, e.g., 127,560 kg of water and 28,000 kg of dissolved solids, 81% of which is organic substance, is fed into vessel 1 through pipe 2. Simultaneously 47,823 kg of steam condensate of 40° C. and 6,092 kg of warm water of 151° C. are fed into the vessel 1 through pipes 3 and 4, respectively, together with 13,425 kg of steam of 100° C. through pipe 24, so that altogether 194,900 kg of diluted black liquor of 80° C. is present in the vessel 1. This black liquor solution having a temperature of 80° C. is pumped by means of the pump 5 through pipe 6 to preheater 7, into which at the same time 29,026 kg of steam of 5 atmospheres absolute pressure is introduced through pipe 8, from steam generator 9, which imparts to the solution fed from the preheater 7 to high-pressure pump 10 a temperature of 151° C. and is further conveyed through pipe 11 to a reactor vessel 12, which is under a pressure of steam and gas of 149 atmospheres above atmospheric, and constitutes the first combustion step in which 90% of the combustion heat of the liquor is assumed to be set free. Simultaneously, 113,000 $m^3$ of air compressed to 150 atmospheres absolute pressure is supplied to the reactor from compressor 13. Of this quantity of air, 50,000 $m^3$ is fed through pipe 14 to scrubber 15, within which it in countercurrent flow meets an aqueous solution of 310° C. coming from cyclone 16 supplied through pipe 17 to the top of the scrubber and recycled from the lower part thereof by means of pump 29 into the reactor vessel 12. In the scrubber, the air is saturated with steam and preheated to about 300° C. and conducted via pipe 18 to the bottom section of final oxidation reactor 19, while at the same time about 50,000 kg of a solution containing soda and Na-salts and having a temperature of 310° C. is fed from the cyclone 16 to the top of the reactor 19 through pipe 20. In the final oxidation step, 6,400,000 Cals are produced which generate about 20,000 kg of steam of 310° C., which escapes from the top of the reactor 19 together with 50,000 $m^3$ of air containing about 2.5% $CO_2$. The escaping gas, since it is saturated with steam of 310° C., carries along, in addition to the 20,000 kg of steam generated in the reactor 19, about 29,000 kg of steam which the air has taken up in the scrubber 15, while it is being preheated by direct contact with the 310° C. aqueous solution therein. The mixture of steam and gas from the reactor 19 is introduced through the pipe 11 together with 63,000 $m^3$ of air coming from the compressor 13 via pipe 21 into the reactor vessel 12, enough of molecular oxygen thus being supplied to this reactor vessel 12 for combustion of 90% of the organic substance contained in the black liquor. At the same time, 170,000 kg of steam of 310° C. and 156,000 kg of gas under a steam-gas pressure of 149 atmospheres above atmospheric, i.e., 0.92 kg of gas per kg of steam, escape from the top of the reactor vessel 13 via cyclone 16. Theoretically, a working pressure of 124 atmospheres above atmospheric should be sufficient, but, in order to ensure reliability in operation, some predetermined over-pressure must exist, and 149 atmospheres above atmospheric should guarantee that difficulties due to a drop of temperature in the reactor will not arise as a consequence of escape of a steam-gas mixture too rich in steam. The residual burnout portion of the black liquor is withdrawn from the reactor 19 through pipe 22. This residual portion, amounting to 30,000 kg of water and 4,770 kg of soda, about 10%–15% of which may consist of sodium acetate, is recycled to the pulp cooking equipment with the causticized liquor. The withdrawn soda solution is expanded to atmospheric pressure in a cyclone 23, causing 13,425 kg of steam to escape through pipe 24 to the vessel 1. From the cyclone, the soda solution of 100° C. leaves through pipe 28 and is diluted at the same time with 13,425 kg of water of 40° C. through pipe 25, whereby the soda solution regains a volume of 30,000 kg of water containing 4,770 kg of soda, which is fed to tank 26. From the tank 26, the warm soda solution is conveyed through pipe 27 to be causticized and fed to a digester.

The steam and gas escaping from the reactor 12 via the cyclone 16 and consisting of 170,000 kg of steam and 156,250 kg of combustion gases are introduced into a heat exchanger 30 and cooled down under full pressure of 149 atmospheres above atmospheric for generation of steam of 34 atmospheres above atmospheric from feed water of 151° C. Hereby the steam and gas of 310° C. are cooled down to 249° C., while, at the same time, 134,355 kg of saturated steam under a pressure of 34 atmospheres above atmospheric leave steam boiler 31 through pipe 32. Steam, condensate and gas of 249° C. from the heat exchanger 30 are fed to heat exchanger 33 through the pipe line 34 for generation of steam of 4 atmospheres above atmospheric from water of 151° C. The steam is withdrawn from the steam generator 9 through pipe 36 in an amount of 41,690 kg, 29,026 kg of which are supplied to the preheater 7 via the line 8, and in this way the disposable quantity of steam of 4 atmospheres above atmospheric will amount to 12,624 kg.

From the residual condensate steam and gas, which are still under the pressure of 149 atmospheres above atmospheric, warm water of 151° C. is produced by causing steam condensate of 20° C. to exchange heat with condensate and gas withdrawn from the heat exchanger 33 and conveyed through pipe 37 to a second heat exchanger 38 for production of warm feed water. Condensate and gas leaving the heat exchanger 38 are collected in a pressure vessel 49, within which they have a temperature of 40° C. and are subjected to a gas pressure of 149 atmospheres above atmospheric. 182,137 kg of condensate of 20° C. is conveyed from vessel 41 by pump 42 through pipe 39 to the heat exchanger 38, where the condensate is heated to 151° C. and conveyed further to a column 45 via pipe 44 and relieved of dissolved carbon dioxide and other gases before the feed water of 150° C. is supplied to the steam generator 9 and steam boiler 31 by pump 46 via pipe 49. A surplus of warm water of 151° C. amounting to 6,092 kg is conveyed through pipe 4 to the vessel 1 for dilution of the black liquor. 134,355 kg of steam subjected to a pressure of 34 atmospheres above atmospheric is fed from the boiler 31 via pipe 32 to superheater 50, where the steam is superheated to 420° C. and conveyed further to a reaction turbine 51, which delivers 15,700 kW at a back pressure of 11 atmospheres above atmospheric. Back pressure steam is drawn off from a steam accumulator 52. The gas and condensate streaming to the pressure vessel 40 is later conducted through pipe 55 to a water turbine 56 driving an electric generator which delivers 480 kW. The gas still under pressure is passed through pipe 57 via a superheater 58 to an expansion machine 59 which drives an electric generator producing 27,000 kW. The superheaters 50 and 58 are heated by hot flue gases from the furnace 60, which process consumes an amount of heat corresponding to 2.7 tons of oil per hour.

In the wet combustion of black liquor according to the preceding example for production of steam and recovery of chemicals, the heat content of the steam represents 92% of the calorific value of the dry substance content of the liquor. For comparison may be mentioned that, according to a corresponding manner of calculation for a plant with soda furnace, the result is about 56%.

If the additional heat required for superheating the steam and the non-condensable gas and the generation of a minor surplus of energy are disregarded, the calories in the steam represent 74.3% of the calories in the liquor and the additional fuel generates all the power needed for operation of pumps, auxiliary machines and compressors. The additional heat which is supplied corresponds to 0.095 Swedish Crowns per kWh, if the price for heavy oil is assumed to be Swedish Crowns 1,000 per ton.

I claim:

1. In the wet combustion method of combusting organic material including oxidation-resistant substances of lignocellulosic origin comprising low-molecular-weight acids which comprising the group including acetic acid proprionic acid or salts thereof, dissolved or suspended in a liquid comprising waste liquor obtained from wood pulping processes in which the organic material is oxidized by contact with air or oxygen at a temperature ranging between 180° C. and 340° C. and at a correspondingly superatmospheric pressure, the improvement comprising:

(a) a first oxidizing step, in which the organic material is partially oxidized by introducing into said liquid a molecular oxygen at a temperature and superatmospheric pressure and in an amount corresponding substantially to the theoretical value required to release a portion on the order of 75%–95% of the total heat value of said organic material;

(b) a second oxidizing step, in which high temperature superatmospheric molecular oxygen is introduced into said liquid in an amount in excess of the theoretical value sufficient to oxidize the residual oxidation-resistant substances and to impart to the effluents generated in said second step a molecular oxygen content sufficient to achieve the partial oxidation in said first step; and (c) feeding the thus oxygenated effluents to said first step.

2. The method according to claim 1, in which oxidation in the first step is carried out by passing a stream of heated compressed air concurrently with a flow of said liquid within a confined reaction zone, and in which the oxidation in the second step is carried out by passing a stream of hot compressed air countercurrent to a flow of said liquid within a separate confined reaction zone.

* * * * *